US011118367B2

(12) United States Patent
Conrard

(10) Patent No.: US 11,118,367 B2
(45) Date of Patent: Sep. 14, 2021

(54) DEVICE FOR ENHANCING SWIMMING POOLS BY CREATING A BUBBLING AND/OR SPARKLING EFFECT

(71) Applicant: Vincent Conrard, Hennecourt (FR)

(72) Inventor: Vincent Conrard, Hennecourt (FR)

( * ) Notice: Subject to any disclaimer, the term of this patent is extended or adjusted under 35 U.S.C. 154(b) by 0 days.

(21) Appl. No.: 16/768,713

(22) PCT Filed: Dec. 19, 2018

(86) PCT No.: PCT/IB2018/060359
§ 371 (c)(1),
(2) Date: Jun. 1, 2020

(87) PCT Pub. No.: WO2019/123325
PCT Pub. Date: Jun. 27, 2019

(65) Prior Publication Data

US 2021/0172189 A1 Jun. 10, 2021

(30) Foreign Application Priority Data

Dec. 21, 2017 (FR) ..... 1771413

(51) Int. Cl.
*A61H 33/02* (2006.01)
*E04H 4/14* (2006.01)

(52) U.S. Cl.
CPC ..... *E04H 4/14* (2013.01); *A61H 33/025* (2013.01)

(58) Field of Classification Search
CPC ..... E04H 4/14; A61H 33/025
USPC ..... 4/496
See application file for complete search history.

(56) References Cited

U.S. PATENT DOCUMENTS 3,420,227 A * 1/1969 Voorlas ..... A61H 33/025 601/168
3,870,040 A * 3/1975 Klages ..... A61H 33/025 601/168
4,269,797 A * 5/1981 Mikiya ..... A61H 33/025 261/122.1

(Continued)

FOREIGN PATENT DOCUMENTS

DE 19609332 A1 9/1997
DE 102013106845 A1 1/2015

(Continued)

*Primary Examiner* — Huyen D Le
(74) *Attorney, Agent, or Firm* — Leason Ellis LLP

(57) ABSTRACT

The invention relates to a device for enhancing swimming pools by creating a bubbling and/or sparkling effect on a given surface. The invention relates to a device in the form of a mat for creating a diffusion of air bubbles rising on all or part of the surface of a swimming pool, making it possible to enhance an already-built swimming pool in a simple manner by adding bubbling and/or sparkling water effects. The device is made up of four major elements which are the multi-layer mat, of which the upper surface is perforated so as to provide the sought bubbling effect, the perforated edge strip attached to the appropriate side of the mat and to which a distribution cone is linked that, in turn, is connected to an air compressor. When the compressor is started up, the output flow is distributed evenly over the entire surface of the mat. The device according to the invention is especially intended for enhancing all types of swimming pools and leisure pools.

4 Claims, 3 Drawing Sheets

(56) References Cited

U.S. PATENT DOCUMENTS

| | | | | |
|---|---|---|---|---|
| 4,625,715 | A * | 12/1986 | Bucher | A61H 33/60 261/122.1 |
| 6,277,086 | B1 * | 8/2001 | Wu | A61H 33/025 601/158 |
| 9,512,020 | B2 | 12/2016 | Mollen | |
| 2009/0089924 | A1 * | 4/2009 | Jan | A61H 33/60 4/541.5 |

FOREIGN PATENT DOCUMENTS

| | | | |
|---|---|---|---|
| GB | 688946 | A | 3/1953 |
| WO | 9325484 | A1 | 12/1993 |

* cited by examiner

DEVICE FOR ENHANCING SWIMMING POOLS BY CREATING A BUBBLING AND/OR SPARKLING EFFECT

CROSS-REFERENCE TO RELATED PATENT APPLICATIONS

This application is a U.S. National Stage Application under 35 U.S.C. § 371 of International Patent Application No. PCT/IB2018/060359, filed Dec. 19, 2018, which claims the benefit of priority of French Patent Application numbers FR 1771413 filed Dec. 21, 2017, both of which are incorporated by reference in their entireties. The International Application was published on Jun. 27, 2019, as International Publication No. WO 2019/123325 A1.

The present invention relates to a device in the form of a mat for creating a uniform diffusion of air bubbles on all or part of the surface of a swimming pool.

Currently, no devices exist that make it possible to enhance an already-built swimming pool in a simple manner by adding bubbling and/or sparkling water effects.

Indeed, the current technologies that make it possible to achieve bubbling and/or sparkling water effects are generally costly and complex to install.

Moreover, these technologies do not make it possible to achieve a uniform bubbling and/or sparkling water effect over a large area to be covered, such as a swimming pool.

The device according to the invention serves to remedy this drawback.

The invention relates to a device for enhancing swimming pools by creating a bubbling and/or sparkling effect, characterised in that it comprises a surface for diffusion of air bubbles similar to a multilayer mat incorporating a metallic structure partly or completely matching (covering) the bottom of the swimming pool and connected by means of the edge strip by a distribution cone, which is itself connected to a compressor located in the immediate vicinity of the swimming pool or in the latter's technical room, wherein said device comprises a perforated upper layer fixed to the metallic structure.

The metallic structure is made of hollow bars serving both as ballast and as a network for distribution of the air injected by the edge to which the perforated flexible edge strip of said mat is fixed. The perforated flexible strip is adjusted such that each perforation lies opposite a space between the ballast bars or opposite a section of ballast bar.

The Device is characterised in that at least one U-shaped piece is fixed to the edge opposite that to which the perforated strip is fixed in order to direct the air injected into the bar towards the empty adjacent space between this bar and the next in order to create a closed air circuit in which the only exit is the upper perforated layer and in that the distribution cone is designed to be connected on one side, either to the suction point or to a compressor adjacent to the pool and on the other, to the entire length of the mat.

Other advantages and characteristics of the invention will appear upon studying the description and drawings in which:

FIG. 1 schematically shows an edge of the mat according to the invention;

Figure 1:
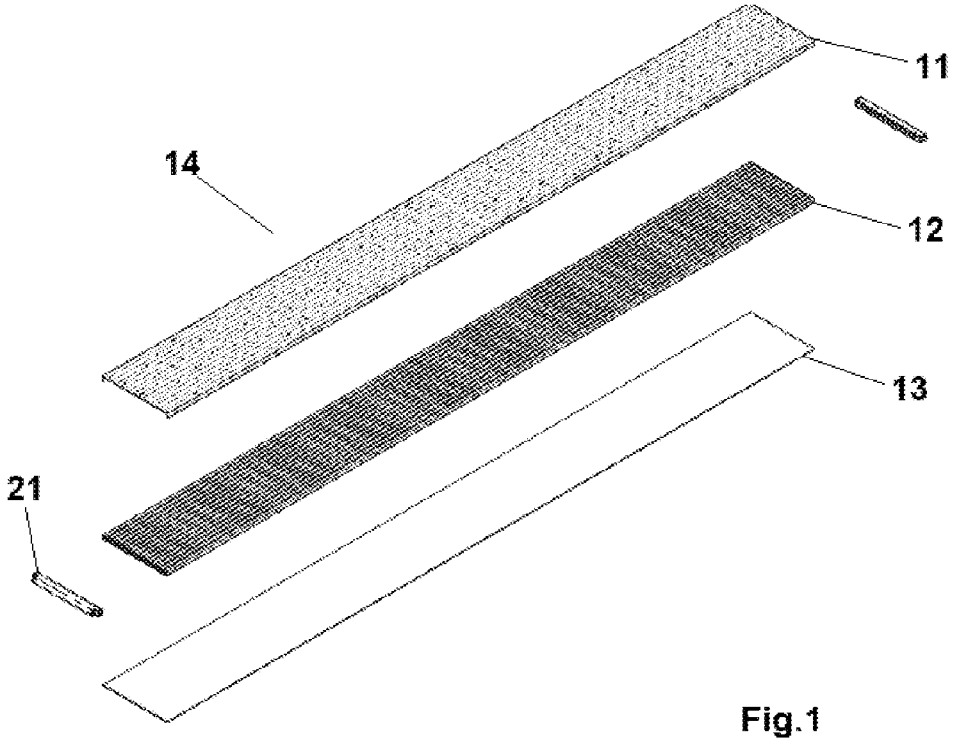
Figure 2:
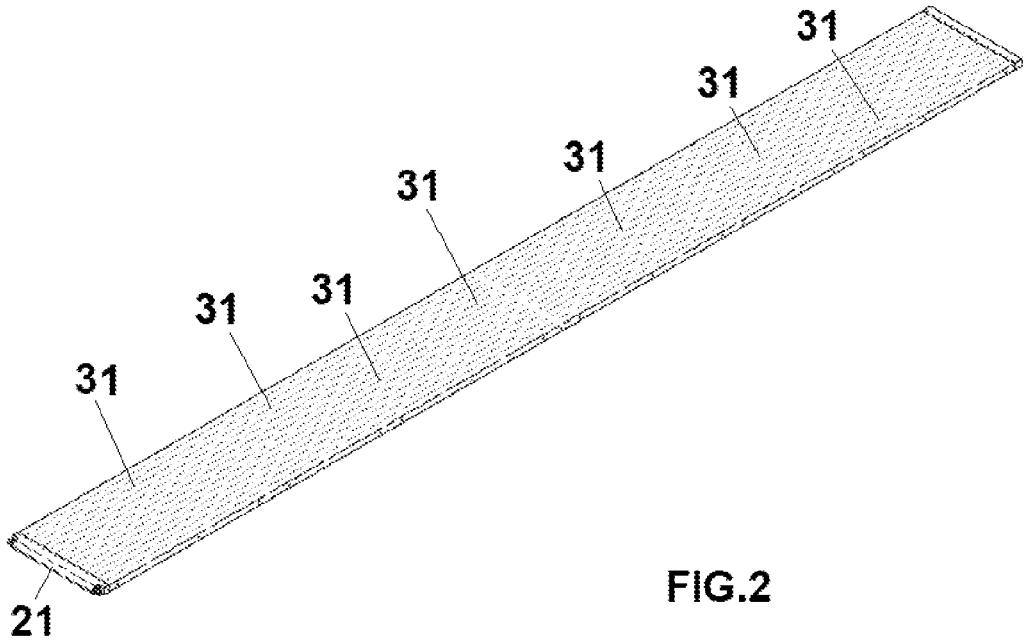
FIG. 2 shows the perforated layer of an edge according to the invention.
Figure 3:
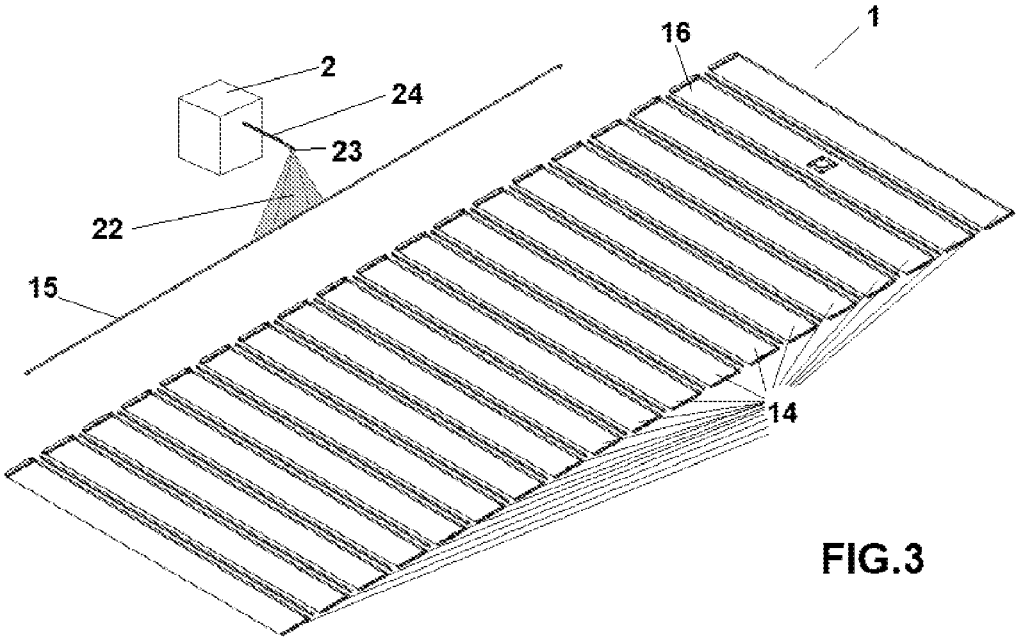
FIG. 3 shows the complete system of the mat and its air supply according to the invention.

It indeed comprises, according to a first characteristic, a mat 1 consisting of at least 3 layers. The lower layer 11 made of flexible polymer, is solid and serves as a support for the intermediate layer 12, which is nothing other than a hollow metallic structure 17 acting as ballast. Another so-called upper layer 13 is fixed to this structure and is perforated. It is therefore a mat 1 with a sandwich structure, having an empty space between the lower and upper layers of polymer. The mat 1 is formed of successive edges 14, mounted parallel to each other. A flexible plastic strip, or edge strip 15, will be fixed to the appropriate edge 14 of the mat 1 determined by its proximity in relation the suction point 23 or simply in relation to the air injection source 21.

The air supply is provided by a compressor 2 dimensioned according to the size of the swimming pool and connected to this perforated flexible strip 15 along the edge 14 of the mat 1 by a conical-shaped part 22, the base of which passes through the latter and acts as a distribution element.

The device is supplied with air via the distribution cone 22 connecting the mat 1 to the compressor 2.

This distribution cone 22 is designed so as to distribute the air uniformly over the entire length of the edge 14 of the mat comprising the flexible strip 15 with an adequate flow rate to feed all the perforations 31 present along the perpendicular to this length which corresponds, in a standard application configuration, to the width of the swimming pool.

The mat 1 also features a cutout having the exact size of the bottom strip exactly at the position where the latter is located in the pool for which it has been created. According to particular embodiments:

- The geometry of the metallic structure 17 varies according to the shape of the swimming pool and according to the presence and shape of immerse access steps.
- The shape and dimensions of the mat 1 vary according to the dimensions of the swimming pool.
- The polymer-based material of which the mat 1 is made varies according to the customer's wishes, by varying its texture for a soft or hard feel.
- The density and diameter of the perforations 31 vary depending on the desired effect. A sparse network of large perforations 31 will yield the bubbling effect, whereas conversely, a dense network of microperforations will yield a sparkling effect. Addition of a microperforated layer incorporated in the upper layer 13 of the device can be considered in order to accentuate this effect.
- The location and size of the reservation for the bottom strip varies according to the swimming pool.
- The location of the compressor 2 may be either in the technical room of the swimming pool or next to the swimming pool itself. In the first case, it may therefore be connected to the distribution pipe and therefore to the mat 1 via the existing pipe system, using either the backflow vents or the suction point 23 if the latter exists and in the second case, directly via the distribution pipe connected to the mat.
- The shape of the distribution cone 22 varies depending on the layout of the pool in order to be able to capture the air flow at its tip and distribute it over the necessary length through its base.

According to an alternative embodiment of the invention, the function of the distribution cone 22 is performed by a structure comprising 2 ducts (not illustrated) joined at a point, this point being connected to the suction point 23, whereby the two ducts subsequently extend along a substantially vertical plane in the opposite direction to each other. The ends of these two ducts are subsequently both connected to a flexible perforated strip 15.

A concrete application of the device can be described as follows for a 4 m*8 m conventional rectangular swimming pool with a constant depth of 1 m50, with a suction point 23 and access by simple ladder and to which one wishes to add a bubbling effect. This is one of the most common cases, which is why it is presented here.

The invention will comprise 3 main elements:

The air compression system 2, located in this case in the technical room, alongside the pump supplying the suction point, is connected to latter's outlet pipe with a Y-piece, each arm of which comprises a valve and the base of which is connected to the original pipe supplying the suction point 23. Hence, the Y-piece has one arm connected to the water pump and one connected to the air compressor supplying the invention.

The distribution cone 22 made of rigid plastic which, in this specific application, adopts the shape of an isosceles triangle, the apex of which is connected to the suction point and the base of which is slipped, before installation in the swimming pool, into the flexible perforated strip 15 described below. A Y-shaped double valve system integrated in the distribution cone 22 serves either to send air into this pipe or water into the pool cleaner by closing either of the arms of the Y-piece, the base of which is directly connected to the suction point. Hence, depending on whether one wishes to clean the swimming pool or use the invention, it will be sufficient to respectively close the valve of the arm of the Y-piece connected to the distribution cone 22 or that of the arm of the Y-piece connected to the pool cleaner hose. When using the invention, the air will spread through the cone 22 before being distributed along the perforated edge strip 15 and subsequently into the mat 1 and will be discharged in the form of bubbles via the perforated upper layer 13 of the mat 1.

The mat 1 which, in this case, will be a 4 m*8 m PVC foam rectangle 4 cm thick covering the bottom of the swimming pool will incorporate a metallic structure 17 of lead bars of hollow square section spaced 20 cm apart and parallel to each other placed perpendicularly to the side of the swimming pool on which the suction point 23 is located. The perforations 31 are parallel to the lead bars and are spaced equidistantly between 2 lead bars. Two rows of perforations 31 are therefore also spaced 20 cm apart. The distance between the perforations 31 of a same line is 10 cm. A flexible perforated strip 15 is welded to the edge of the mat 1 on the side nearest to the suction point 23. This strip forms a U-shaped profile on its side with its back facing the edge of the mat and which will serve as a slide into which the above-mentioned distribution cone 22 will be inserted. On this strip, a perforation 3 cm in diameter will be present opposite each lead bar section and opposite each space between these bars and therefore, at the same time, opposite each row of perforations 31 present on the mat. U-shaped plastic parts are fixed on the edge opposite the edge to which the perforated strip is fixed. The aim of this U-shaped part is to direct the air injected into the lead bar towards the empty adjacent space between this bar and the next, thereby creating a closed air circuit, the only exit from which is the row of perforations 31 of the upper layer 13 of the mat 1. The aim of this device is to ensure uniformity of air distribution in terms of flow rate passing through the upper layer of the mat.

The aim of the device according to the invention is to equip and enhance as many already-built swimming pools as possible.

The invention therefore relates to a device for enhancing swimming pools by creating a bubbling and/or sparkling effect, characterised in that it comprises a surface for diffusion of air bubbles similar to a multilayer mat partly or completely covering the bottom of the swimming pool and connected by means of the edge strip 15 by a distribution cone 22, which is itself connected to a compressor 2 located in the immediate vicinity of the swimming pool or in the latter's technical room.

According to embodiments:

- the mat 1 comprises, on the appropriate edge 14, a perforated flexible strip 15, adjusted such that each perforation 31 lies opposite a space between the ballast bars or opposite a section of ballast bar according to the invention.
- the mat 1 comprises a metallic structure 17 made of hollow bars serving both as ballast and as a network for distribution of the air injected by the edge to which the perforated flexible edge strip 15 of said mat 1 is fixed.
- the mat 1 comprises, on the edge opposite the edge incorporating the perforated flexible strip 15, a U-shaped part, one end of which is fixed to the hollow section of the ballast bar and the other end to the inter-layer space of the mat created between this same bar and the following bar.
- the distribution cone 22 is designed to be connected on one side, either to the suction point 23 or to a compressor 2 adjacent to the pool and on the other, to the entire length of the mat 1.

The invention claimed is:

1. Device for enhancing swimming pools by creating a bubbling and/or sparkling effect, wherein said enhancing device comprises a surface for diffusion of air bubbles similar to a multilayer mat (1) incorporating a metallic structure (17) adapted to partly or completely match the bottom of a swimming pool, characterised in that the multilayer mat is connected by means of a perforated flexible edge strip (15) of the mat by a distribution cone (22), which is itself adapted to be connected to a compressor (2) located in the immediate vicinity of the swimming pool or in the latter's technical room, and in that said multilayer mat furthermore comprises a perforated upper layer (13) fixed to the metallic structure (17) of the mat (1) and being made of hollow bars serving both as ballast and as a network for distribution of the air injected by an edge (14) to which the perforated flexible edge strip (15) of said mat (1) is fixed.

2. Device according to claim 1, characterised in that the perforated flexible strip (15) is adjusted such that each perforation lies opposite a space between the ballast bars or opposite a section of ballast bar.

3. Device according to claim 1, characterised in that at least one U-shaped piece is fixed to the edge (14) opposite that to which the perforated strip (13) is fixed in order to direct the air injected into the bar towards the empty adjacent space between this bar and the next in order to create a closed air circuit in which the only exit is the upper perforated layer (13).

4. Device according to claim 1, characterised in that the distribution cone (22) is designed to be connected on one side, either to the suction point (23) or to a compressor adjacent to the pool and on the other, to the entire length of the mat (1).

* * * * *